United States Patent [19]

Pfizenmaier

[11] Patent Number: 4,852,492

[45] Date of Patent: Aug. 1, 1989

[54] DEVICE FOR AFTERTREATING A COATED OR PRINTED MATERIAL WEB

[75] Inventor: Wolfgang Pfizenmaier, Neckargemünd, Fed. Rep. of Germany

[73] Assignee: Heidelberger Druckmaschinen AG, Heidelberg, Fed. Rep. of Germany

[21] Appl. No.: 273,132

[22] Filed: Nov. 14, 1988

Related U.S. Application Data

[63] Continuation of Ser. No. 44,793, Apr. 30, 1987, abandoned.

[30] Foreign Application Priority Data

Apr. 30, 1986 [DE] Fed. Rep. of Germany ..... 3614742

[51] Int. Cl.[4] ..... B41F 23/04

[52] U.S. Cl. ..... 101/424.1; 101/423; 34/120

[58] Field of Search ..... 101/416 A, 365, 423, 101/425, 416.1, 424.1; 34/85, 117, 120; 15/256.5, 256.51, 256.52

[56] References Cited

U.S. PATENT DOCUMENTS

| | | | |
|---|---|---|---|
| 1,756,841 | 4/1930 | Ullring | 101/425 |
| 1,772,470 | 8/1930 | Snyder | 101/425 |
| 3,065,487 | 11/1962 | Scott | 15/256.51 |
| 3,656,200 | 4/1972 | Riley | 101/425 X |
| 3,835,779 | 9/1974 | Ross et al. | 101/425 |
| 3,868,780 | 3/1975 | Soininen et al. | 34/117 |
| 4,462,169 | 7/1984 | Daane | 34/62 |
| 4,648,942 | 3/1987 | Wanke et al. | 34/117 |

FOREIGN PATENT DOCUMENTS

| | | | |
|---|---|---|---|
| 351051 | 7/1979 | Austria . | |
| 1042611 | 11/1958 | Fed. Rep. of Germany . | |
| 1511183 | 11/1969 | Fed. Rep. of Germany . | |
| 2716613 | 10/1978 | Fed. Rep. of Germany . | |
| 2828184 | 1/1979 | Fed. Rep. of Germany . | |
| 3305749 | 9/1983 | Fed. Rep. of Germany | 34/62 |

*Primary Examiner*—Edgar S. Burr
*Assistant Examiner*—James Lisehora
*Attorney, Agent, or Firm*—Herbert L. Lerner; Laurence A. Greenberg

[57] ABSTRACT

A device for aftertreating a material web, coated or printed on at least one side thereof, having a drier for heating the material web to vaporize solvents contained therein, a vapor channel connected to the drier and traversible by the material web, and an arrangement of cooling rollers located downstream of the vapor channel, each of the cooling rollers being enveloped by the material web over a region of the circumference of the cooling rollers, respectively, a first one of the cooling rollers located in the travel direction of the material web having a jacket surface thereof facing towards the coated or printed side of the web includes a doctor blade device having a transversing doctor blade engaging a region of the first cooling roller located between an oncoming strand and a departing strand of the material web.

6 Claims, 3 Drawing Sheets

25
17
37
38
28
29
20
26
36
13
14
9
24
18
27
35
32
23
34
33
33
31
21
19
20

DEVICE FOR AFTERTREATING A COATED OR PRINTED MATERIAL WEB

This application is a continuation of application Ser. No. 044,793, filed Apr. 30, 1987, now abandoned.

FIELD OF THE INVENTION

The invention relates to a device for aftertreating a material web coated or printed on at least one side thereof, a device for aftertreating a material web, coated or printed on at least one side thereof, having a drier for heating the material web to vaporize solvents contained therein, a vapor channel connected to the drier and traversible by the material web, and an arrangement of cooling rollers located downstream of the vapor channel, each of the cooling rollers being enveloped by the material web over a region of the circumference of the cooling rollers, respectively, a first one of the cooling rollers located in the travel direction of the material web having a jacket surface thereof facing towards the coated or printed side of the web.

In the case of printing machines, aftertreatment of such material webs takes place with the aim of accelerating the evaporation of the solvents contained in the printing inks and drying the printing inks to such an extent that the quality of the print format is retained during subsequent manipulations with the material web, for example in a folding apparatus.

DESCRIPTION OF RELATED ART

In the case of a heretofore known device from German Published Nonprosecuted Application (DE-OS) No. 33 05 749, for this purpose, the material web, after printing, runs through a drier in which the web is heated, and through a succeeding vapor channel with a blow nozzle arrangement which produces a flow of air in the vapor channel opposite the direction of movement of the material web. After leaving the vapor channel, the web is then directed over a cooling roller arrangement, due to the cooling action of which the printing ink is set.

The purpose of the vapor channel arrangement which is subjected to blowing air in this manner is to reduce the concentration of solvent in the air surrounding the material web before the web reaches the cooling roller arrangement, on which large quantities of solvent would otherwise condense.

In the heretofore known device, a blowing device is also provided having a flow of air in the vicinity of a cooling roller directed towards the surface of the web facing away from the cooling roller and substantially in radial direction towards the cooling roller.

This is meant to provide close contact between the material web and the cooling roller in order to avoid an air gap which may otherwise occur between these surfaces wherein remaining solvent can vaporize, and to ensure a rapid drop in the web temperature below the vaporization point of the solvent to the effect that the small quantities of condensate yet remaining are reabsorbed by the material web and do not collect on the cooling roller.

The effectiveness of all of these measures is reduced the higher the speed of the material web. Particularly at high web speeds, close contact of the web with the cooling roller can be achieved only with considerable blowing pressure acting upon the surface of the web, rendering high powered blowers necessary.

SUMMARY OF THE INVENTION

It is accordingly an object of the invention, therefore to provide a device of the type specified in the introduction hereto which is particularly suitable for high web speeds.

With the foregoing and other objects in view, there is provided, in accordance with the invention, a device for aftertreating a material web, coated or printed on at least one side thereof, having a drier for heating the material web to vaporize solvents contained therein, a vapor channel connected to the drier and traversible by the material web, and an arrangement of cooling rollers located downstream of the vapor channel, each of the cooling rollers being enveloped by the material web over a region of the circumference of the cooling rollers, respectively, a first one of the cooling rollers located in the travel direction of the material web having a jacket surface thereof facing towards the coated or printed side of the web, comprising a doctor blade device having a traversing doctor blade engaging a region of the first cooling roller located between an oncoming strand and a departing strand of the material web.

A roller offset printing machine can be operated with a doctor blade device arranged in accordance with the invention also with intensive ink application at web speeds in excess of 6.5 meters per second without solvent condensates having an adverse effect on the printing quality. Extensive facilities are not required for this purpose such as are disclosed in the aforementioned German published application in order to displace or dislodge the air gap occurring between the material web and the cooling roller, into which solvent can vaporize.

In accordance with another feature of the invention, the doctor blade device includes a collection vessel for receiving therein solvent condensate wiped away by the doctor blade.

In accordance with an additional feature of the invention, the collection vessel has a drainage connection coupling connectible to a disposal device for solvent condensate.

In accordance with an added feature of the invention, the doctor blade is exchangeable and has vulcanized cast elastomer resin located at least in a region thereof contacting the cooling roller.

In accordance with a further feature of the invention, the doctor blade is longer than the width of the material web by at least twice a single travel distance of the traversing doctor blade device.

In accordance with a concomitant feature of the invention, there is provided a swivel device operatable by a control cylinder for swivelling the doctor blade device away from and against the cooling roller, the swivel device having an adjustable spring for determining the contact force between the doctor blade and cooling roller.

The invention furthermore pursues the objective that, instead of further preventative measures relating to the formation of condensate on the first cooling roller, such measures should be taken with the aim of reducing adverse consequences thereof, using the simplest possible means. In this way, the problem of break-up of the layer of air containing solvent vapors in the vicinity of the material web and which heretofore has not been satisfactorily solved in the state of the art is then of secondary importance.

Other features which are considered as characteristic for the invention are set forth in the appended claims.

Although the invention is illustrated and described herein as embodied in a device for aftertreating a coated or printed material web, it is nevertheless not intended to be limited to the details shown, since various modifications and structural changes may be made therein without departing from the spirit of the invention and within the scope and range of equivalents of the claims.

BRIEF DESCRIPTION OF THE DRAWING

The construction and method of operation of the invention, however, together with additional objects and advantages thereof will be best understood from the following description of specific embodiments when read in connection with the accompanying drawings, in which.

DESCRIPTION OF THE PREFERRED EMBODIMENT

Figure 1:
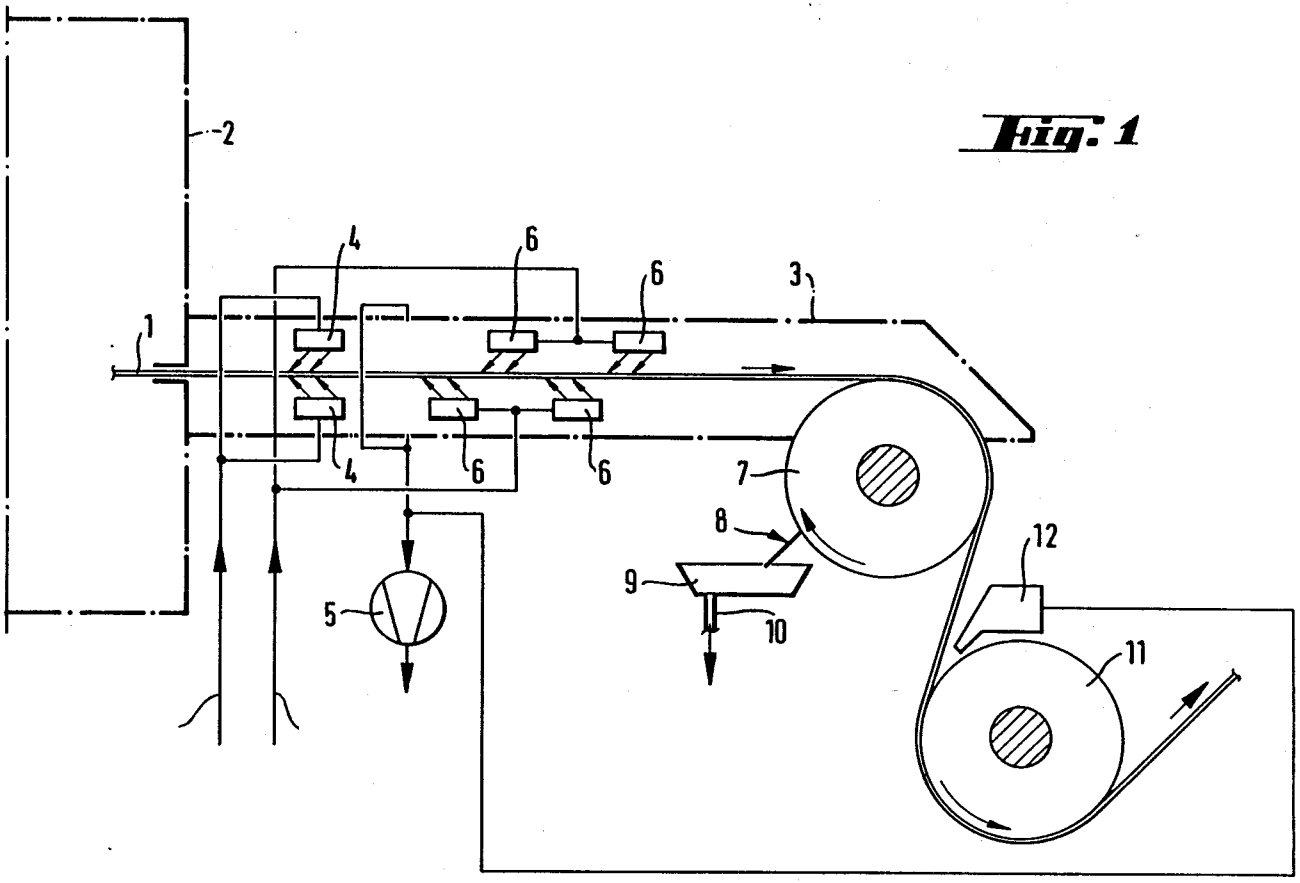
FIG. 1 is a diagrammatic, elevational view of an inventive device for subsequent treatment of a coated or printed web, the device being equipped with a cooling roller doctor blade.

Referring now to the drawing and first, particularly, to FIG. 1 thereof, there is shown in diagrammatic form a device for subsequent treatment of a coated or printed material web. In this case, the material web 1 is preferably a paper web printed on both sides which has passed through the printing units of a roller offset printing machine. The paper web is subsequently heated in a drier 2. Such driers can be connected to an extraction device 5 used for removing solvent vapors which emerge from the heated ink layer of the printed paper web.

The paper web passes through a slot in a wall of the drier adjacent to a vapor channel 3 and then into the vapor channel 3. To prevent large quantities of solvent vapor from emerging out of the drier 2 through this slot, blocking nozzles 4 are provided which blow hot air into the drier through the slot.

The paper web lentering the vapor channel 3 in hot condition continues to give off solvent which in part is extracted by the vapor extraction device 5. Another part is carried farther or entrained with the paper web 1, on which a boundary layer of air containing solvent at a relatively high concentration forms as a result of subsequent evaporation of solvent from deeper layers of ink.

The solvent concentration of this boundary layer is partly reduced with the aid of nozzles 6 which direct a flow of blowing air at the paper web 1 substantially in a direction opposite the direction of movement of the paper web 1.

A complete "break-up" of this boundary layer is not achieved in this way, however, so that the paper web 1 remains surrounded by solvent vapor as it arrives at the first cooling roller 7. An air gap, intensified or increased at higher web speeds, forms between the surface of the paper web 1 enveloping this cooling roller 7 and the jacket surface of the cooling roller 7. On the one hand, this impairs the cooling effect on the paper web 1 so that the temperature of the paper web 1 in the vicinity of the first cooling roller 7 remains considerably above the vaporization point of the solvent; on the other hand, this air gap makes it possible for the solvent vapors contained within it to continue to diffuse and then collect in the form of condensate on the cold surface of the first cooling roller 7. In German Published Non-Prosecuted Application (DE-OS) No. 33 05 749 to hereinbefore, an arrangement is described, in which compressed air is blown against that surface of a cooling roller which is, at that instant, not enveloped by the paper web. The purpose of this measure is evidently to displace or dislodge the solvent condensate from the cooling roller and to prevent this solvent from coming into contact again with the region of the web which is newly directed towards the cooling roller.

This is also one of the aims of the invention of the instant application. The pneumatic displacement or dislodgement of the aforecited German application requires, on the one hand, a powerful blower, thereby considerably increasing the operating costs of a printing machine, and also causing an intolerable solvent mist to be formed about the printing machine and in its immediate surroundings. In the invention, however, a device is provided which prevents harmful solvent vapor from being given off at the machine and particularly into the machine room.

To solve the aforementioned task and to achieve the stated advantages, the invention makes use of a doctor blade device associated with the first cooling roller which, in an extremely simple yet effective way, markedly reduces the solvent concentration of the ink layer facing towards the first cooling roller already at this cooling roller stage.

With the doctor blade device 8 (FIG. 1) the solvent condensate precipitated on the first cooling roller 7 is skimmed or wiped off into a collection vessel 9, from which it can be drained off in controlled quantities via a drainage connection 10.

In this way, the wiped-off solvent is lost in a desirable way in the further process because it would otherwise, without being wiped, be carried back by the rotating cooling roller 7 into the air gap between this cooling roller 7 and the paper web 1. This would result in a condensation diffusion balance forming in the air gap when a high solvent concentration is present in the ink layer, thereby counteracting after-vaporization of solvents from deeper ink layers. The strand of the paper web 1 running off the first cooling roller 7 would therefore, without being wiped, still have a relatively high percentage of solvent in the deeper layers of the ink layer facing towards the cooling roller 7. For the yet relatively hot paper web, this in turn would result in considerable afterdiffusion from the lower ink layers along its farther path, so that the surface of the ink already hardened in the drier 2 would soften once again. Contact of a thereby softened ink layer with subsequent cooling rollers would result in the formation of ink deposits, extremely small initially but quickly developing and spoiling the print format.

In accordance with the invention, a doctor blade device functioning as described hereinabove, is provided only at the first cooling roller 7. Bearing in mind the investment costs for a printing machine, the overall length thereof must, among other conditions, be kept as short as possible. This results in short paths of the paper web from the drier 2 to the first cooling roller 7 and, particularly at high paper web speeds, extremely short periods of time available to the ink to reduce its solvent content.

Figure 2:
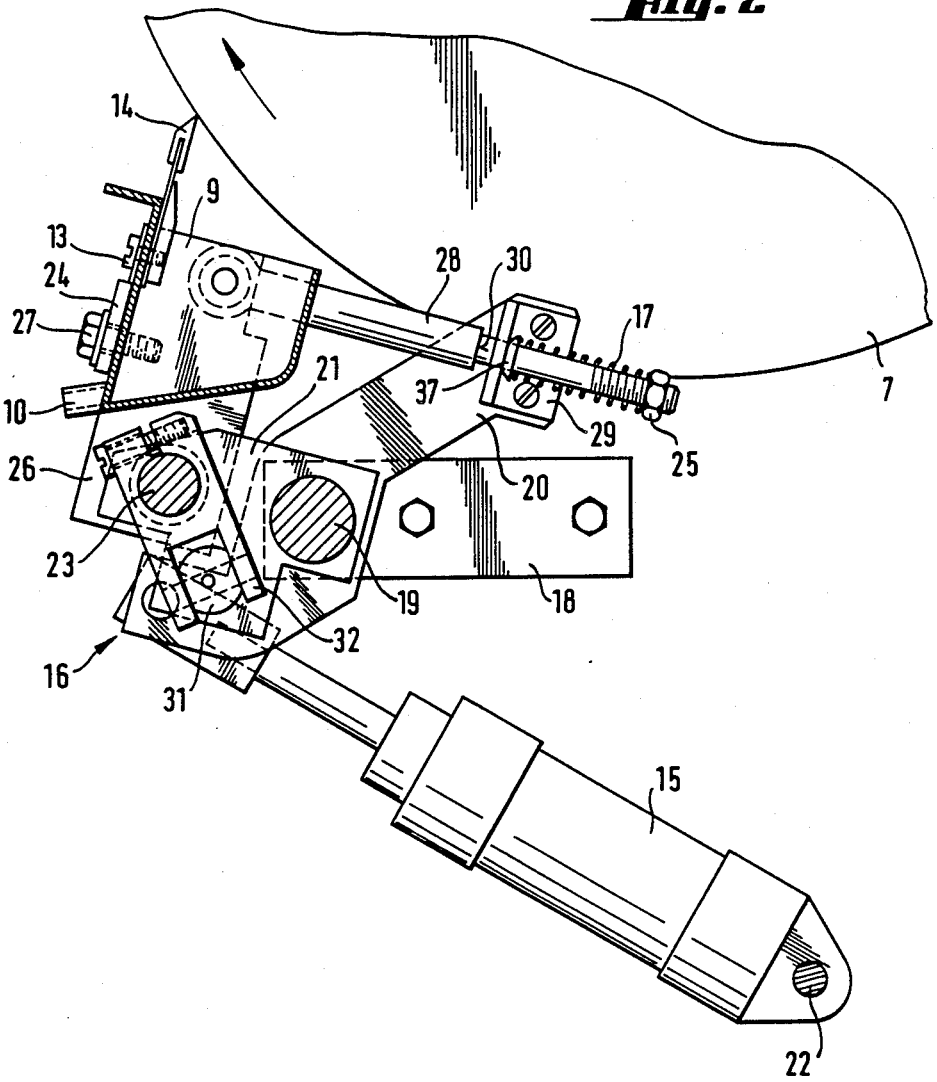
FIG. 2 is an embodiment of a doctor blade device in a pivoted position, with the doctor blade set against the cooling roller.

On the side of the paper web 1 facing away from the first cooling roller 7 (FIG. 1), cooling and vaporization take place, on the one hand, without interaction with the solvent condensate precipitated on the first cooling roller 7 and, on the other hand, over a longer period of time until the second cooling roller 11 (FIG. 1) is reached. Suitable tests have shown that the arrangement of a further doctor blade device at this second cooling roller 11 is rendered unnecessary and that, in this case, to achieve high quality printing results, it is sufficient to provide a conventional arrangement of suction nozzles 12 (FIG. 1) which have the task of drawing off the solvent vapors given off by the surface of the paper web 1 to the surrounding area. FIG. 2 shows an embodiment of a doctor blade device according to the invention arranged at the first cooling roller 7. The doctor blade device features an interchangeable doctor blade 14 bolted with bolts 13 to the inside of the collection vessel 9 and which can be swivelled away from and against the cooling roller 7 by a swivel device 16 operated by a control cylinder 15. The contact force between the doctor blade 14 and the cooling roller 7 is adjustable at a spring 17 with the aid of an adjusting nut 25.

Figure 3:
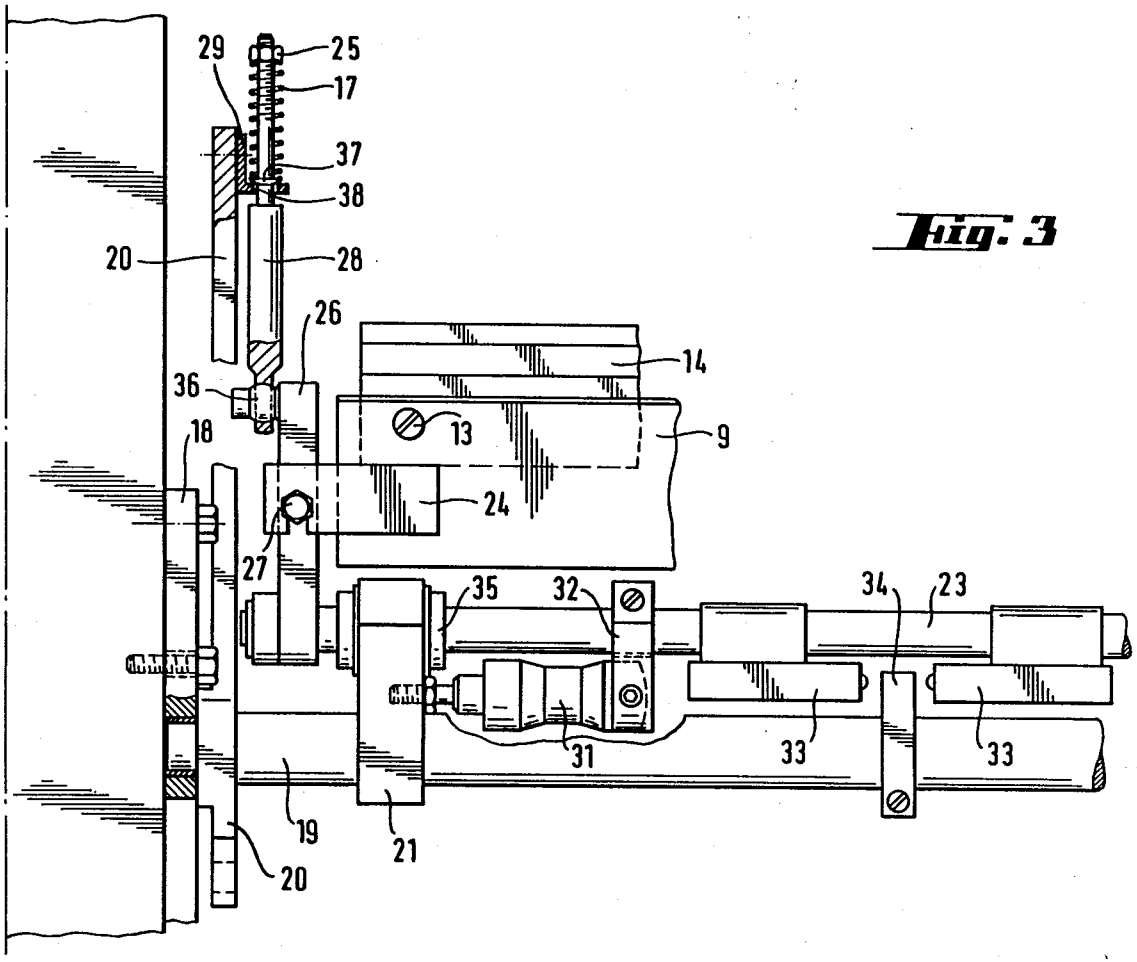
FIG. 3 is a front elevational view of FIG. 2 showing a traversing arrangement for the doctor blade device.

Secured by means of bolts on non-illustrated side walls between which the cooling roller 7 is also mounted are mutually opposing bearing brackets 18. The bearing brackets 8 have a shaft 19 mounted therebetween. A lever 20 and a strap 21 are secured by means of pins to this shaft 19. The lever 20 is pivoted by the cylinder 15 which is, in turn, pivotable about a pin 22 fastened in one of the side walls. The strap 21 pinned to the shaft 19 pivots a cross shaft 23 of a traversing device for the doctor blade 14 which is arranged farther below the latter as shown in FIG. 3. The collection vessel 9 is secured by a bolt 27 via a connection piece 24 to a swivel member 26 pivotably mounted on the cross shaft 23.

A tie rod 28 is articulatingly attached to the swivel member 26. With the aid of this tie rod 28, the doctor blade 14 is pressed against the cooling roller 7 by the spring 17 under adjustable contact pressure. For this purpose, this spring 17 is braced at one end thereof against an angle bracket 29 fastened to the lever 20, the other end of the spring 17 resting against the adjusting nut 25.

The doctor blade device is swivellable into and out of position by a forward and return stroke, respectively, of the cylinder 15. When the doctor blade device is swivelled away or out of position, the tie rod 28 is braced against the bracket 29 by a shoulder 30.

FIG. 3 shows, in a front elevational view of FIG. 2, a traversing device for the doctor blade device. Compared to the positions of the latter shown in FIG. 2, and in the interest of better visibility and clarity, to provide a more clearly arranged illustration in FIG. 3, the cross shaft 23, the lever 20, the swivel member 26 and the tie rod 28 are shown in different angular positions in FIG. 3.

The length of the doctor blade 14 is such that, when it is traversed in any of its positions, at least the jacket region of the cooling roller 7 enveloped by the paper web 1 is covered. Correspondingly, this length is at least greater than the width of the paper web by double the traversing path.

The traversing movement is provided by means of a traversing cylinder 31 which is mounted between a fork 32 affixed to the cross shaft and the strap 21. (To facilitate clear visibility, in FIG. 2, the fork 32 is not shown in its actual position with respect to the cross shaft 23). The traversing cylinder 15 is actuated by means of non-illustrated valves and control lines, the stroke being limited by limit switches 33 which are mounted on the cross shaft 23 and interact with a limit stop 34 connected to the shaft 19.

The cross shaft 23 is mounted in bearing bushings 35 in the straps 21 so that it can be shifted longitudinally. (Only one of the two straps 21 arranged near the respective ends of the shaft 23 is shown in FIG. 3). The swivel member 26 is arranged so that it cannot be shifted in longitudinal direction of the cross shaft 23 and is linked to an end of the tie rod 28 by means of a connecting rod head 36. The spring 17 slid onto the other end of the tie rod 28, abuts the angle bracket 29 via a spherical disc 37.

In the position shown in FIG. 3, the tie rod 28 pivots backwards and forwards in the seat of the spherical disc 37 in the drawing plane during the traversing. The size of the opening 38 in the angle bracket 29 through which the tie rod 28 passes, is selected in accordance with the deflection of the pivot movement.

In an advantageous embodiment of the invention, the doctor blade 14 is provided with a vulcanized cast elastomeric resin in the region of contact with the cooling roller 7. This facilitates a satisfactory service life of the doctor blade 14. If the doctor blades 14 are worn, they can be replaced by new ones due to the detachable screw-type connection thereof, to the collection vessel 9. To carry out corresponding service work and in order to clean the collection vessel 9, the entire doctor blade device can be swivelled away from the cooling roller 7 in the manner described farther above. The collector reservoir 9 can be removed from the machine after loosening the screws 27.

The foregoing is a description corresponding in substance to German Application No. P 36 14 742.7, dated Apr. 30, 1986, the International priority of which is being claimed for the instant application, and which is hereby made part of this application. Any material discrepancies between the foregoing specification and the aforementioned corresponding German application are to be resolved in favor of the latter.

I claim:

1. Device for aftertreating a material web which is coated or printed on at least one side thereof, the device having a drier for heating the material web to vaporize solvents contained therein, a vapor channel connected to the drier and traversible by the material web, and an arrangement of cooling rollers located downstream of the vapor channel, each of the cooling rollers being enveloped by the material web over a region of the circumference of the cooling rollers, respectively, a first one of the cooling rollers located in the travel direction of the material web having a jacket surface thereof facing towards the coated or printed side of the web, the device comprising a doctor blade device having a traversing doctor blade engaging a region of the circumference of the first cooling roller located opposite the region thereof envelopede by the material web and disposed between an oncoming strand and a departing strand of the material web.

2. Device according to claim 1, wherein said doctor blade device includes a collection vessel for receiving therein solvent condensate wiped away by said doctor blade.

3. Device according to claim 2, wherein said collection vessel has a drainage connection coupling connectible to a disposal device for solvent condensate.

4. Device according to claim 1, wherein said doctor blade is exchangeable by another doctor blade and has vulcanized cast eleastomer resin located at least in a region thereof contacting the cooling roller.

5. Device according to claim 1, wherein said traversing doctor blade is traversible a given travel distance in a given travel direction, and is longer than the width of the material web by at least twice said given travel distance.

6. Device according to claim 1, including a swivel device for swivelling said doctor blade device away from and against the cooling roller, a control cylinder having a piston connected to said swivel device for operating said swivel device, said swivel device having an adjustable spring for determining the contact force between said doctor blade and said cooling roller.

* * * * *